US007905273B2

(12) United States Patent
Dodds et al.

(10) Patent No.: US 7,905,273 B2
(45) Date of Patent: Mar. 15, 2011

(54) METHOD OF FORMING A CAST METAL ARTICLE

(75) Inventors: Gerald C. Dodds, Chardon, OH (US); Jonathan Jarrabet, Sanford, NC (US); Lawrence D. Graham, Chagrin Falls, OH (US)

(73) Assignee: PCC Airfoils, Inc., Beachwood, OH (US)

( * ) Notice: Subject to any disclaimer, the term of this patent is extended or adjusted under 35 U.S.C. 154(b) by 495 days.

(21) Appl. No.: 11/899,217

(22) Filed: Sep. 5, 2007

(65) Prior Publication Data

US 2009/0056902 A1 Mar. 5, 2009

(51) Int. Cl.
*B22C 9/04* (2006.01)

(52) U.S. Cl. ..... 164/516; 164/519; 164/369

(58) Field of Classification Search ..... 164/28, 164/516, 519, 369
See application file for complete search history.

(56) References Cited

U.S. PATENT DOCUMENTS

| | | | | |
|---|---|---|---|---|
| 5,580,837 | A | 12/1996 | Dodds et al. | |
| 6,637,500 | B2 * | 10/2003 | Shah et al. | 164/369 |
| 6,929,054 | B2 | 8/2005 | Beals et al. | |
| 2006/0086479 | A1 * | 4/2006 | Parkos et al. | 164/369 |
| 2007/0116972 | A1 * | 5/2007 | Persky | 428/457 |

* cited by examiner

*Primary Examiner* — Kuang Lin
(74) *Attorney, Agent, or Firm* — Tarolli, Sundheim, Covell & Tummino LLP

(57) ABSTRACT

An unfired ceramic base core having a first coefficient of thermal expansion is provided. A core element having a second coefficient of thermal expansion is positioned in an opening formed in the unfired ceramic base core. The opening in the unfired ceramic base core is filled with a filler material having a third coefficient of thermal expansion. The third coefficient of thermal expansion is greater than the first coefficient of thermal expansion and less than the second coefficient of thermal expansion. The ceramic base core is fired without cracking the base core and without cracking the filler material. The ceramic base core contains silica and zircon and has a silica content of 70% or less and a zircon content of 30% or more. The core element may be formed of a ceramic material or a refractory metal.

19 Claims, 4 Drawing Sheets

METHOD OF FORMING A CAST METAL ARTICLE

BACKGROUND OF THE INVENTION

The present invention relates to a method of forming a cast metal article using a core assembly having a base core with a core element disposed in an opening formed in the base core.

Ceramic cores have previously been utilized to form openings or passages in cast metal articles, such as turbine engine components. The turbine engine components may be blades or vanes. In U.S. Pat. No. 6,929,054, it is suggested that a refractory metal article, such as a wire or sheet, can be cut and utilized as a core element in association with a ceramic base core.

When a core element is used in combination with a ceramic base core, difficulty may be encountered due to the ceramic base core having a different coefficient of thermal expansion than the core element. For example, the core element may be a refractory metal article having a coefficient of thermal expansion of approximately $7.0\times10^{-6}$ inches per inch per degree centigrade. The ceramic base core may be formed of silica and have a coefficient of thermal expansion of approximately $0.5\times10^{-6}$ inches per inch per degree centigrade. The relatively high coefficient of thermal expansion of the core element can result in a cracking of the ceramic base core during firing.

SUMMARY OF THE INVENTION

The present invention provides a new and improved method of forming a cast metal article. The method includes providing a ceramic base core having a first coefficient of thermal expansion. A core element having a second coefficient of thermal expansion is positioned in an opening formed in the ceramic base core. The core element may, for example, be formed of a refractory metal or a ceramic material. Of course, the core element may be formed of other materials.

The opening in the ceramic base core is filled with filler material having a third coefficient of thermal expansion. The third coefficient of thermal expansion may be greater than the first coefficient of thermal expansion and less than the second coefficient of thermal expansion.

Although it is contemplated that the ceramic base core may have many different compositions, the ceramic base core may contain silica and zircon. It is also contemplated that the filler material may have many different compositions. However, the filler material may contain silica and zircon. Alternatively, the filler material may contain mullite. Regardless of its composition, the filler material may advantageously be formed of particles having substantially the same particle size.

The present invention includes many different features which may advantageously be utilized together as disclosed herein. Alternatively, the features may be utilized separately or in various combinations with each other and/or with features from the prior art.

BRIEF DESCRIPTION OF THE DRAWINGS

The foregoing and other features of the present invention will become more apparent upon a consideration of the following description taken in connection with the accompanying drawings wherein.

DESCRIPTION OF SPECIFIC PREFERRED EMBODIMENTS OF THE INVENTION

Figure 1:
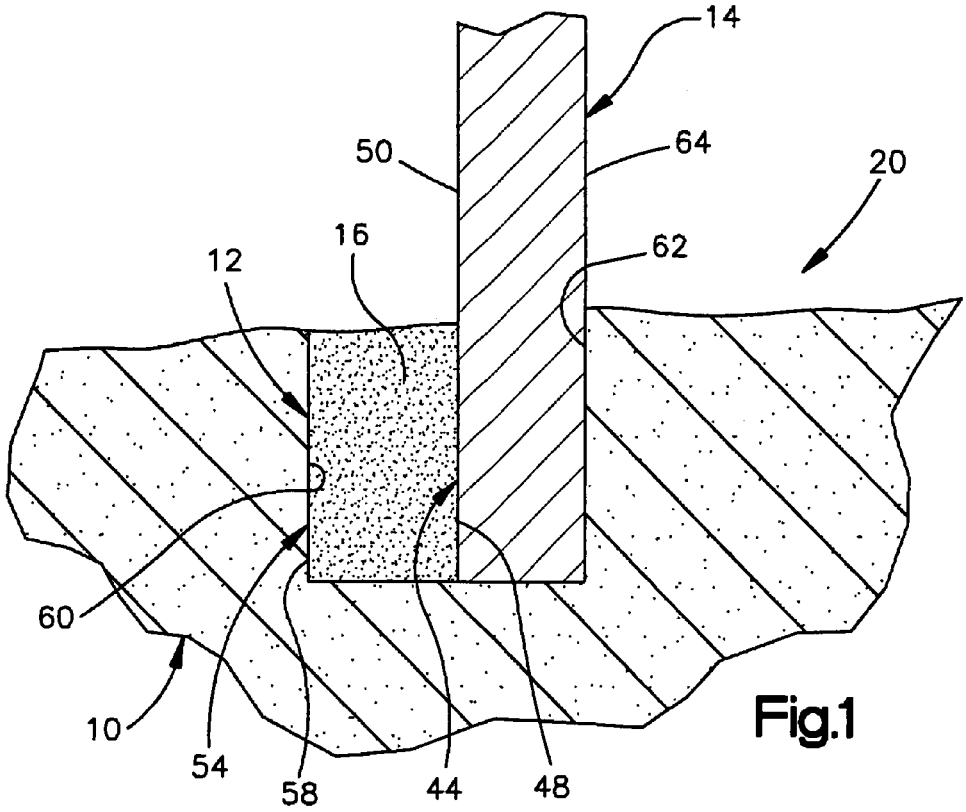
FIG. 1 is an enlarged fragmentary schematic illustration depicting the relationship between a ceramic base core, a refractory metal core element which is received in an opening in the base core, and filler material which is received in the opening in the base core.
Figure 2:
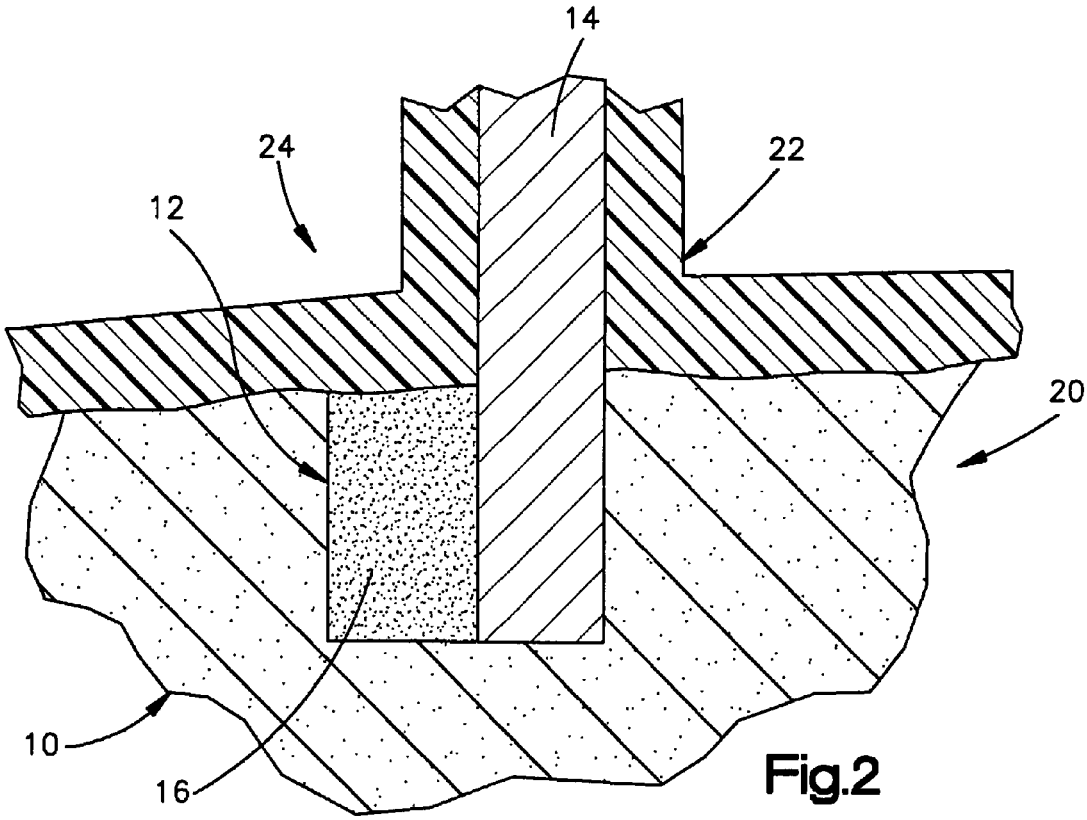
FIG. 2 is a schematic illustration, generally similar to FIG. 1, illustrating the relationship between the base core, refractory metal core element and a covering of wax.
Figure 3:
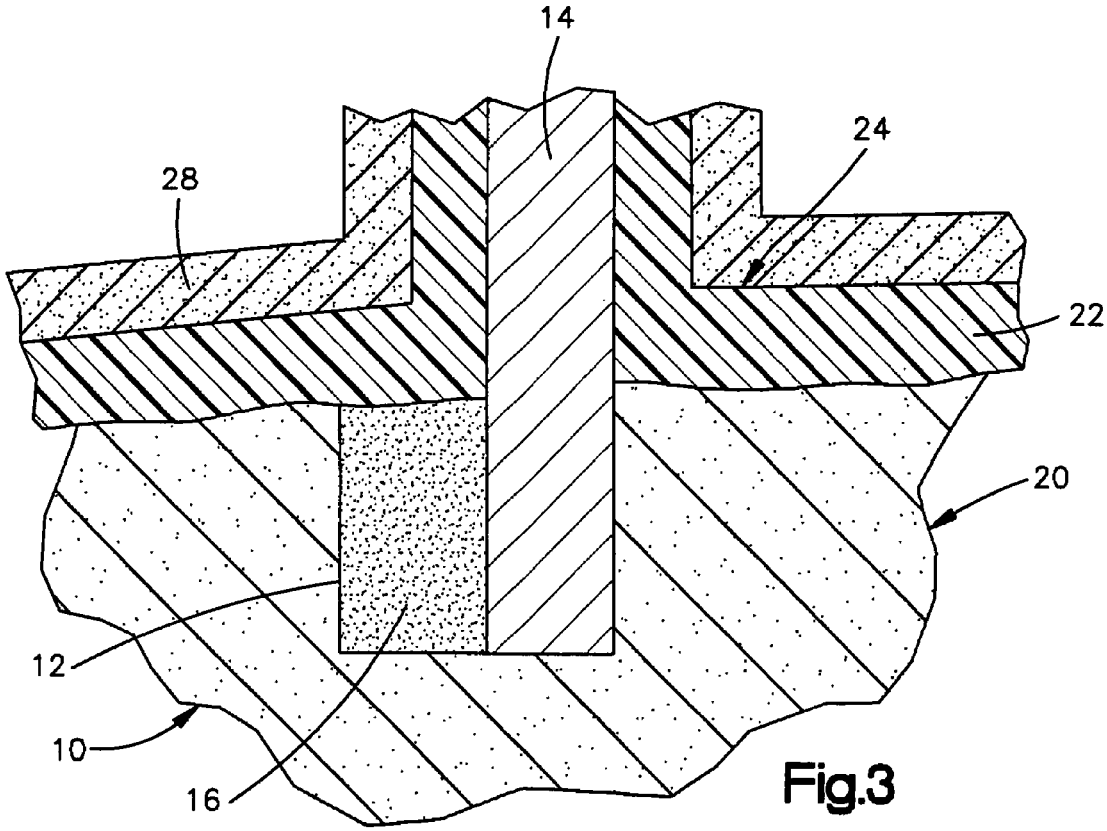
FIG. 3 is a fragmentary schematic illustration, generally similar to FIGS. 1 and 2, illustrating the relationship of a layer of ceramic mold material to the covering of wax, the base core and the refractory metal core element.
Figure 4:
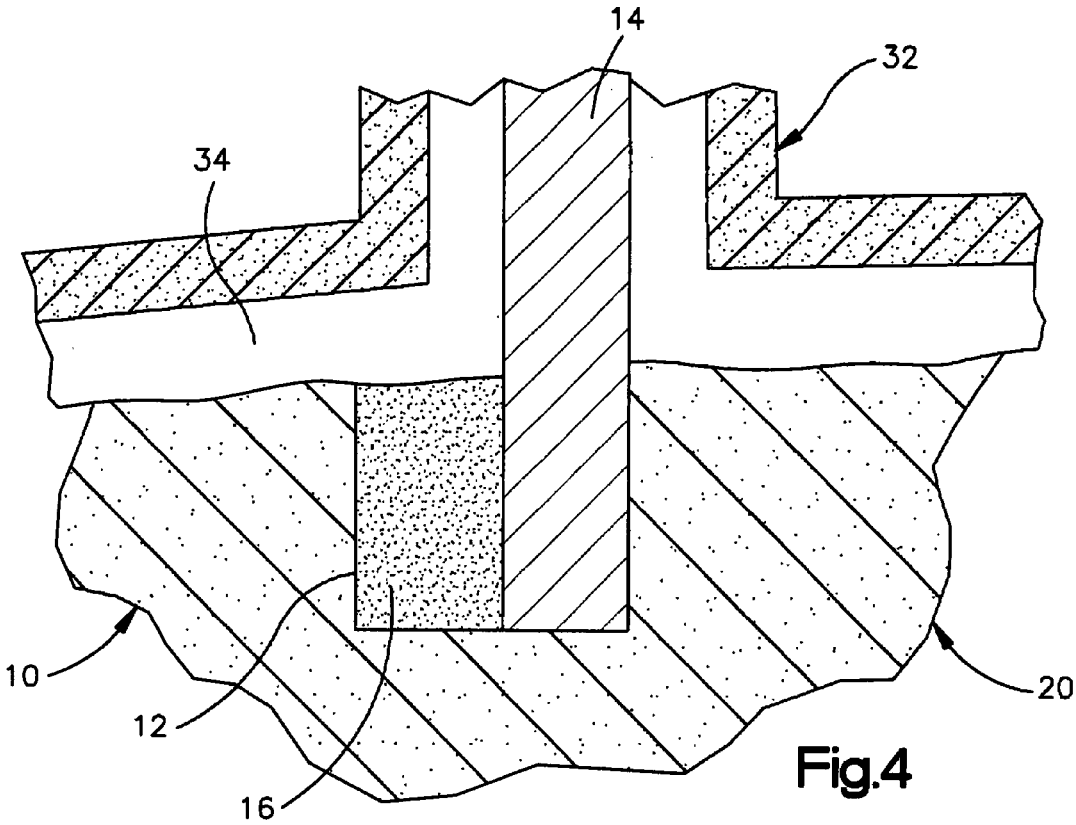
FIG. 4 is a fragmentary schematic illustration, generally similar to FIG. 3, illustrating a space formed in a mold which at least partially encloses the base core and refractory metal core element, by removal of the covering of wax.

A method of forming a cast metal article is illustrated schematically in FIGS. 1-5. An unfired ceramic base core 10 (FIG. 1) has an opening 12 in which a core element 14 is positioned. The opening 12 in the base core 10 is filled with filler material 16. The base core 10, filler material 16, and core element 14 form a core assembly 20 having a configuration corresponding to a configuration of a desired space in a cast metal article.

The cast metal article may be a blade or vane for use in a turbine engine. Alternatively, the cast metal article may be a housing or other portion of a turbine engine. For example, the cast metal article may be a blade outer air seal. It should be understood that the core assembly 20 may be utilized in the making of cast metal articles other than components of a turbine engine.

In the embodiment of the invention illustrated in FIG. 1, the opening 12 is a linear, longitudinally extending slot having a rectangular cross sectional configuration. However, the opening 12 may have a different configuration if desired. For example, the opening 12 may have an arcuate longitudinal and/or transverse cross sectional configuration. The opening 12 may be molded into the base core 10 during formation of the base core or may be cut into the base core after formation of the base core.

The core element 14 is formed of a refractory metal and has the configuration of a flat plate. The opening 12 has a width which is greater than the thickness of the core element 14 so that a portion of the core element can be positioned in the opening. The core element 14 may be formed of different materials and with a different configuration if desired.

Holes may be formed in and projections or tabs may extend from the core element 14. For example the core element 14 may have an arcuate configuration with radially and/or axially extending flanges. The core element 14 may be formed as a wire. The core element 14 may be formed of a refractory metal and may have any one of the configurations disclosed in U.S. Pat. No. 6,929,054 or 6,637,500. Of course, the core element 14 may be formed of a different material and may have a different configuration.

The core element 14 may be formed as one piece or a plurality of pieces. When the core element 14 is formed of a refractory metal, the core element may be formed of molybdenum, tantalum, niobium, tungsten and/or alloys thereof. The refractory metal core element 14 may be an intermetallic compound based on any of the foregoing refractory metals or similar metals.

The core assembly 20 is fired to dry the material of the ceramic base core 10 and the filler material 16. As this occurs, a secure bond is formed between the filler material 16 and both the base core 10 and the refractory metal core element 14. This results in the refractory metal core element 14 being securely held in a desired orientation relative to the base core 10.

Once the core assembly 20 has been fired, a wax covering 22 (FIG. 2) is applied over the core assembly 20. The wax covering may be applied to the core assembly 20 by positioning the core assembly in a die and injecting hot wax around the core assembly. Of course the covering 22 of wax may be applied to the core assembly 20 in a different manner if desired.

The covering 22 of wax cooperates with the core assembly 20 to form a pattern assembly 24. The pattern assembly 24 has a configuration corresponding to the configuration of an article to be cast. The core assembly 20 has a configuration corresponding to the configuration of a desired space or passage within the cast article.

Once the pattern assembly 24 has been formed in the manner previously explained, a layer 28 (FIG. 3) of ceramic mold material is applied over the pattern assembly 24. The layer 28 of ceramic mold material encloses the pattern assembly 24 and is formed with suitable gating.

Figure 5:
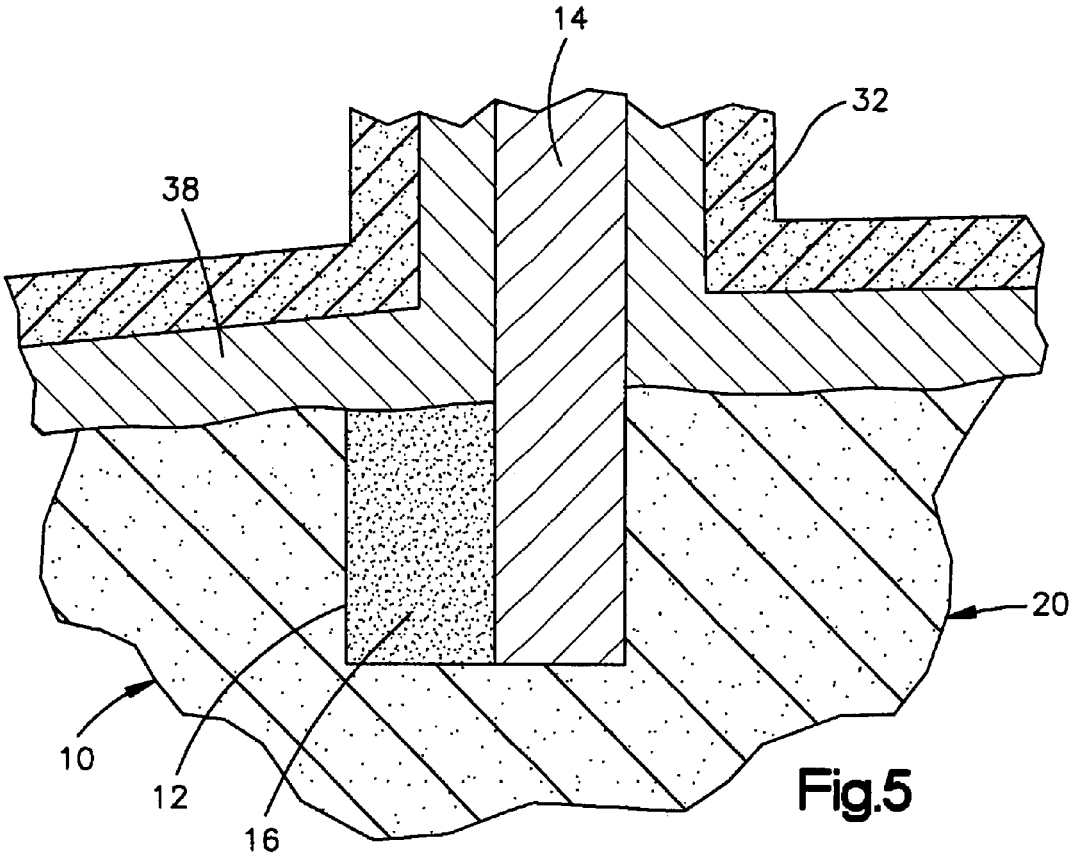
FIG. 5 is a fragmentary schematic illustration, generally similar to FIG. 4, illustrating the manner in which the mold is filled with molten metal.

The layer 28 of wet ceramic mold material is fired or dried to form a mold 32 (FIG. 4) which encloses the core assembly 20. During firing of the layer 28 (FIG. 3) of wet ceramic mold material, the covering 22 of wax is melted and a cavity or space 34 (FIG. 4) is formed within the mold 32. The mold cavity or space 34 has a configuration corresponding to the desired configuration of a cast metal article 38 (FIG. 5). The core assembly 20 which is enclosed by the mold 32 (FIG. 4), has a configuration corresponding to the configuration of a desired space within the cast metal article 38.

To form a cast metal article 38 (FIG. 5), molten metal is poured into the mold cavity 34 (FIG. 4) and solidified around the core assembly 20. This results in the formation of the cast metal article 38 with a configuration corresponding to the configuration of the mold cavity 34. The mold 32 is removed from around the cast metal article 38. The core assembly 20 is then removed from within the cast metal article 38.

Although the cast metal article 38 may be formed of many different metals, the cast metal article 38 is formed of a nickel-chrome superalloy. However, the cast metal article may be formed of titanium, or other metals.

During formation of the cast metal article 38, difficulty has previously been encountered due to cracking of the ceramic base core 10 and/or the filler material 16 during firing of the core assembly 20. This cracking is due, in part at least, to differences in the coefficients of thermal expansion of ceramic base core 10, filler material 16, and refractory metal core element 14 (FIG. 1). The ceramic base core 10 and filler material 16 have previously been formed of silica which has a coefficient of thermal expansion of approximately $0.5\times10^{-6}$ inches per inch per degree centigrade. The refractory metal core element 14 may have been formed of molybdenum which has a coefficient of thermal expansion of approximately $7.0\times10^{-6}$ inches per inch per degree centigrade. It is believed that the different coefficients of thermal expansion of the components of the core assembly 20 have resulted in cracking of the filler material 16 and/or the ceramic base core 10.

In accordance with one of the features of the present invention, the filler material 16 has a coefficient of thermal expansion which is greater than the coefficient of thermal expansion of the ceramic base core 10 and less than the coefficient of thermal expansion of the refractory metal core element 14. This results in two interfaces being established between the components of the core assembly 20. The first interface 44 (FIG. 1) is formed where the filler material 16 engages the refractory metal core element 14. At the interface 44, a surface 48 of the filler material 16 engages a surface 50 on the refractory metal core element 14. During firing of the core assembly 20, force is transmitted between the refractory metal core element 14 and the filler material 16 across the interface 44. This force results from the different coefficients of thermal expansion of the ceramic base core 10, refractory metal core element 14, and the filler material 16.

A second interface 54 (FIG. 1) is formed where the filler material 16 engages the ceramic base core 10. At the second interface 54, a surface 58 of the filler material 16 engages a surface 60 on the ceramic base core 10. The surface 60 forms one side of the opening 12 and faces toward and is spaced from the surface 50 on the refractory metal core element 14.

The surface 60 extends parallel to an opposite side surface 62 of the opening 12 in the ceramic base core 10. A flat side surface 64 (FIG. 1) on the refractory metal core element 14 is disposed in abutting engagement with the side surface 62 of the opening 12. The side surface 62 locates the refractory metal core element 14 relative to the opening 12 and base core 10. It should be understood that the opening 12 and the core element 14 may have a different configuration if desired.

During firing of the core assembly 20, force is transmitted between the filler material 16 and the ceramic base core 10 across the interface 54. Force is also transmitted between the filler material 16 and the refractory metal core element 14 across the interface 44. These forces result from the different coefficients of thermal expansion of the refractory metal core element 14, the filler material 16, and the base core 10. By providing two interfaces, that is, the interface 44 and the interface 54, the magnitude of the force transmitted at either one of the interfaces is reduced. This results in a reduction in stress on the material of the ceramic base core 10 and on the filler material 16.

To provide the two interfaces 44 and 54 between materials having different coefficients of thermal expansion, the coefficient of thermal expansion of the filler material 16 is less than the coefficient of thermal expansion of refractory metal core element 14. In addition, the coefficient of thermal expansion of the filler material 16 is greater than the coefficient of thermal expansion of the ceramic base core 10. If the filler material 16 was to have a coefficient of thermal expansion which was substantially the same as the coefficient of thermal expansion of the ceramic base core 10, only a single interface would be established, that is, the interface 44 between the filler material 16 and the refractory metal core element 14. By forming the core assembly 20 of components having three distinctly different coefficients of thermal expansion, two interfaces 44 and 54 are established between the components of the core assembly. This results in a reduction in stress on the material of the core assembly 20 at any one of the interfaces 44 and 54.

In accordance with another feature of the present invention, the coefficient of thermal expansion of the base core 10 is increased so that it approaches the coefficient of thermal expansion of the refractory metal core element 14. The refractory metal core element 14 may have a coefficient of thermal expansion of approximately $7\times10^{-6}$ inches per inch per degree centigrade. The base core 10 is formed of a mixture of silica and zircon. Silica has a coefficient of thermal expansion of approximately $0.5\times10^{-6}$ inches per inch per inch per degree centigrade. Zircon has a coefficient of thermal expansion of approximately $4.2\times10^{-6}$ inches per inch per degree centigrade. However, it should be understood that the base core 10 may be formed of different materials having different coefficients of thermal expansion.

To increase the coefficient of thermal expansion of the base core 10, the base core is formed of a mixture of silica and zircon. The greater the amount of zircon provided in the base core 10, the greater will be the coefficient of thermal expansion of the base core 10. By increasing the coefficient of thermal expansion of the base core 10, the magnitude of force transmitted between the components of the core assembly 20, during firing of the core assembly, is decreased.

Although it is contemplated that the base core 10 may be composed of different mixtures of silica and zircon, it is believed that the base core 10 should have a silica content of 70% or less and a zircon content of 30% or more. For example, the base core 10 may be formed of a mixture which is 50% silica and 50% zircon. Alternatively, the base core 10 may be formed of a mixture of 60% silica and 40% zircon. The greater the amount of zircon in the ceramic base core 10, the greater will be the coefficient of thermal expansion of the base core. However, core removal problems may occur if to much zircon is utilized in the base core 10.

The silica and zircon forming ceramic base core 10 may have the same particle size. By providing silica and zircon with substantially with same particle size, voids between relatively large particles of one material are not filled by relatively small particles of the other material. This enables a mixture of zircon and silica particles to have a relatively large coefficient of thermal expansion.

Although it is believed that it may be desired to provide a base core 10 containing silica and zircon, the base core may have a different composition if desired. If the base core 10 contains silica and zircon, these materials may be present in percentages different than the specific percentages previously set forth.

The filler material 16 has a coefficient of thermal expansion which is greater than the coefficient of thermal expansion of the ceramic base core 10 and less than the coefficient of thermal expansion of the refractory metal core element 14. The filler material 16, when it is positioned in the opening 12, may be a slurry which is a water based mixture of silica and zircon. If this is the case, the ceramic filler material 16 may have a greater zircon content than the ceramic base core 10.

When the core assembly 20 is dried, water is removed from the silica and zircon forming the filler material 16. This results in shrinkage of the ceramic filler material 16. When the core assembly 20 is fired, additional water is removed from the ceramic filler material 16. This results in additional shrinkage of the ceramic filler material 16.

The silica and zircon in the filler material 16 may have the same particle size. By providing silica and zircon with substantially the same particle size, voids between particles are not filled with other particles. This enables the silica and zircon ceramic filler material 16 to have a relatively large coefficient of thermal expansion.

Alternatively, the filler material 16 may be formed of mullite ($3Al_2O_3.2SiO_2$) with a binder. Mullite has a coefficient of thermal expansion of approximately 5.3 inches per inch per degree Centigrade. In one embodiment of the invention, the ceramic filler material 16 was 60% silica and 40% mullite. The resulting mixture had a coefficient of thermal expansion of approximately $3.0\times10^{-6}$ inches per inch per degree centigrade.

The silica and mullite forming the ceramic filler material 16 may have the same particle size. By providing silica and mullite with substantially the same particle size, voids between particles are not filled with other particles. This enables the silica and mullite ceramic filler material 16 to have a relatively large coefficient of thermal expansion.

The silica and mullite ceramic filler material 16 has a coefficient of thermal expansion which is greater than the coefficient of thermal expansion of the ceramic base core 10 and less than the coefficient of thermal expansion of the refractory metal core element 14. The silica and mullite ceramic filler material 16 may form a slurry which is a water based mixture of silica and mullite. This slurry is used to fill the opening 12 after the core element 14 is positioned in the opening.

When the core assembly 20 is dried, water is removed from the silica and mullite of the ceramic filler material 16. This results in shrinkage of the ceramic filler material 16. When the core assembly is fired, additional water is removed from the silica and mullite of the ceramic filler material 16. This results in additional shrinkage of the silica and mullite of the ceramic filler material 16.

It is believed that the base core 10 can be formed of a mixture of silica and zircon and will advantageously have a coefficient of thermal expansion of approximately $2.0\times10^{-6}$ inches per inch per degree centigrade. The filler material 16 may be formed of a mixture of silica and mullite and have a coefficient of thermal expansion of approximately $3.0\times10^{-6}$ inches per inch per degree centigrade. If desired, the filler material 16 may be formed of a mixture of silica, zircon, mullite and/or other materials.

The foregoing specific percentages of silica, zircon, and/or mullite for use in the base core 10 and filler material 16 have been set forth herein for purposes of clarity of description. It is not intended to limit the invention to a specific percentage of silica, zircon and/or mullite in either the base core 10 or the filler material 16. In addition, the foregoing specific coefficients of thermal expansion for the base core 10, filler material 16, and refractory metal core element 14 have been set forth herein for purposes of clarity of description. It is not intended to limit the invention to specific coefficients of thermal expansion. It should be understood that the coefficients of thermal expansion of the base core 10 and filler material 16 will vary with variations in the silica and/or mullite content of the base core and filler material.

In the embodiment of the invention illustrated in FIGS. 1-5, two interfaces 44 and 54 have been formed between the refractory metal core element 14, the filler material 16 and the ceramic base core 10. In the embodiment of the invention illustrated in FIG. 6, four interfaces are formed between the ceramic base core, filler material and refractory metal core element. Since the embodiment of the invention illustrated in FIG. 6 is generally similar to the embodiment of the invention illustrated in FIGS. 1-5, similar numerals will be utilized to identify similar components, the suffix letter "a" being associated with the numerals of FIG. 6 to avoid confusion.

Figure 6:
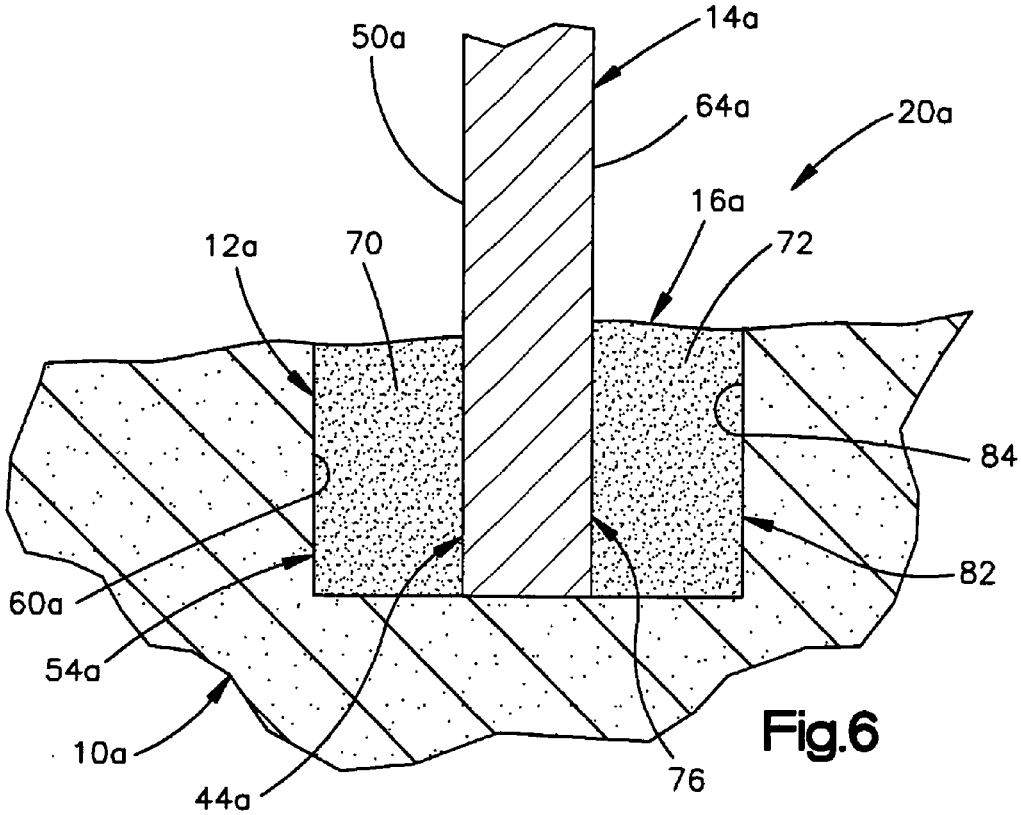
FIG. 6 is a fragmentary schematic illustration, generally similar to FIG. 1, depicting the manner in which the refractory metal core element may be positioned in an opening in the base core with filler material located between opposite sides of the refractory metal core element and surfaces of the opening in the base core.

A core assembly 20*a* includes a ceramic base core 10*a* (FIG. 6). A refractory metal core element 14*a* is received in an opening 12*a* formed in the ceramic base core 10*a*. Filler material 16*a* is disposed on opposite sides of the refractory metal core element 14*a*. Thus, a first body 70 of filler material is disposed on the left (as viewed in FIG. 6) side of the refractory metal core element 14*a*. Similarly, a second body 72 of filler material is disposed on the right side of the refractory metal core element 14*a*.

The two bodies 70 and 72 of filler material cooperate with the ceramic base core 10*a* and refractory metal core element 14*a* to form four interfaces. Thus, a first interface 44*a* is formed where the body 70 of filler material engages a side surface 50*a* of the refractory metal core element 14*a*. A second interface 54*a* is formed between the first body 70 of filler material and a side surface 60*a* of the ceramic base core 10*a*.

In accordance with a feature of the embodiment of the invention illustrated in FIG. 6, a third interface 76 is formed between the second body 72 of filler material and a side surface 64*a* of the refractory metal core element 14*a*. A fourth interface 82 is formed between the second body 72 of filler material and a side surface 84 of the opening 12*a* in the base core 10*a*.

By forming four separate interfaces 44*a*, 54*a*, 76 and 82 between the ceramic base core 10*a*, filler material 16*a* and refractory metal core element 14*a*, the amount of force which is transmitted across any one of the interfaces is reduced with a resulting reduction in the stress applied to the ceramic base core 10*a* and the filler material 16*a*. Of course, reducing the stress applied to the ceramic base core 10*a* and filler material 16*a* is effective to reduce any tendency for these components of the core assembly 20*a* to crack during firing of the core assembly.

The base core 10*a* (FIG. 6) may be composed of different mixtures of silica and zircon. It is believed that the base core 10*a* may have a silica content of 70% or less and a zircon content of 30% or more. For example, the base core 10*a* may be formed of a mixture which is 50% silica and 50% zircon. Alternatively, the base core 10*a* may be formed of a mixture of 60% silica and 40% zircon. The greater the amount of zircon in the base core 10*a*, the greater of coefficient of thermal expansion of the base core. However, core removal problems may occur if to much zircon is utilized in the base core 10*a*.

Although it is believed that it may be desired to provide a base core 10*a* containing silica and zircon, the base core may have a different composition if desired. If the base core 10*a* contains silica and zircon, these materials may be present in percentages different than the specific percentages previously set forth.

The filler material 16*a* has a coefficient of thermal expansion which is greater than the coefficient of thermal expansion of the ceramic base core 10*a* and less than the coefficient of thermal expansion of the refractory metal core element 14*a*. The filler material 16*a* may be a slurry which is a water based mixture of silica and zircon. If this is the case, the filler material 16*a* may have a greater zircon content than the ceramic base core 10*a*. The filler material slurry fills the opening 12*a* after the core element 14*a* has been positioned in the opening.

When the core assembly 20*a* is dried, water is removed from the silica and zircon filler materials 16*a*. This results in shrinkage of the filler material 16*a*. When the core assembly 20*a* is fired, additional water is removed from the ceramic filler material 16*a*. This results in additional shrinkage of the ceramic filler material 16*a*.

The silica and zircon in the filler material 16*a* may have the same particle size. By providing the silica and zircon with substantially the same particle size, voids between particles are not filled with other particles. This enables the silica and zircon filler material 16*a* to have a relatively large coefficient of thermal expansion.

Alternatively, the filler material 16*a* may be formed of mullite ($3Al_2O_3.2SiO_2$) with a binder. Mullite has a coefficient of thermal expansion of approximately 5.3 inches per inch per degree centigrade. In one embodiment of the invention, the filler material 16*a* was approximately 60% silica and 40% mullite. The resulting mixture had a coefficient had a coefficient of thermal expansion of approximately $3.0\times10^{-6}$ inches per inch per degrees centigrade. Of course, the filler material 16*a* may contain silica and mullite in percentages other than the foregoing percentages.

The silica and mullite forming the filler material 16*a* may have the same particle size. By providing silica and mullite with substantially the same particle size, voids between particles are not filled with other particles. This enables the silica and mullite of the ceramic filler material 16*a* to have a relatively large coefficient of thermal expansion. If desired, the silica may be omitted from the filler material 16*a* if this is done, a different material may or may not be substituted for the silica.

The silica and mullite filler material 16*a* has a coefficient of thermal expansion which is greater than the coefficient of thermal expansion of the ceramic base core 10*a* and less than the coefficient of thermal expansion of the refractory metal core element 14*a*. The silica and mullite filler material 16*a* may be a slurry which is a water based mixture of silica and mullite. Of course, the filler material may contain materials other than silica and mullite.

It is believed that the base core 10*a* may be formed of a mixture of silica and zircon and may have a coefficient of thermal expansion of approximately $2.0\times10^{-6}$ inches per inch per degree centigrade. The filler material 16*a* may be formed of a mixture of silica and mullite and may have a coefficient of thermal expansion of approximately $3.0\times10^{-6}$ inches per inch per degrees centigrade. If desired, the filler material 16*a* may be formed of a mixture of a silica, zircon, mullite and/or other materials.

In the embodiments of the invention illustrated in FIGS. 1-6, the core element 14 is formed of a refractory metal. In the embodiment of the invention illustrated in FIG. 7, the core element is formed of a ceramic material. Since the embodiment of the invention illustrated in FIG. 7 is generally similar to the embodiment of the invention illustrated in FIGS. 1-6, similar numerals will be utilized to identify similar components, the suffix letter "b" being associated with the numerals of FIG. 7 to avoid confusion.

Figure 7:
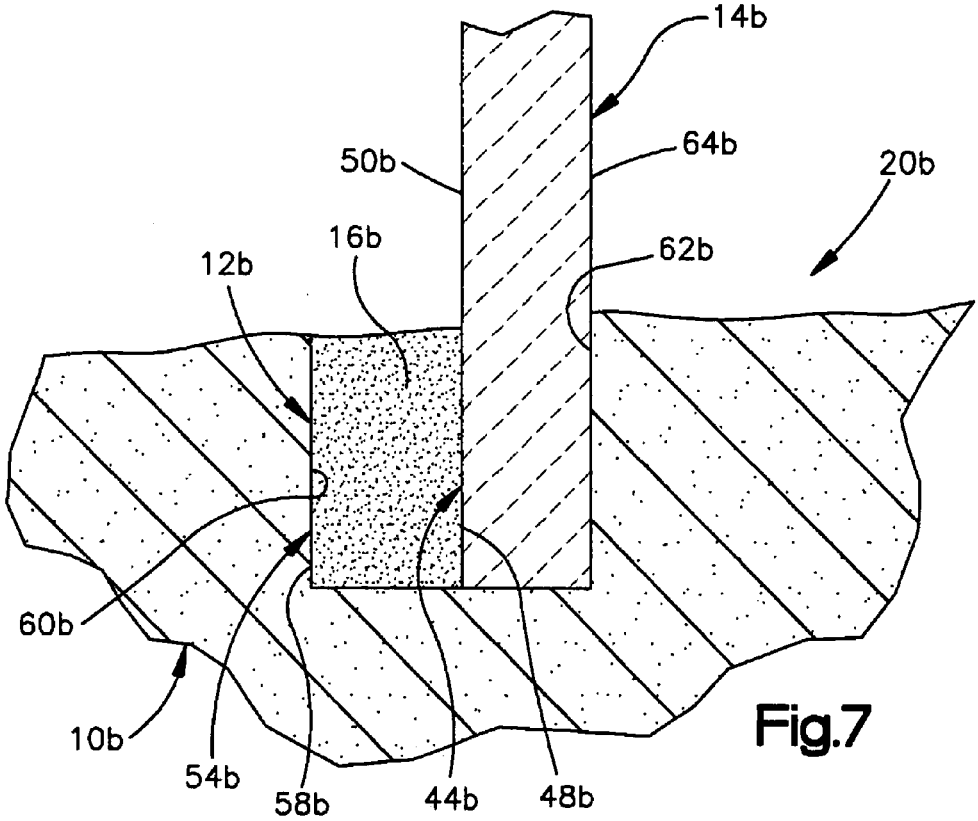
FIG. 7 is a fragmentary schematic illustration, generally similar to FIG. 1, depicting the manner in which a ceramic core element may be positioned in the base core so that the filler material is located between one side of the ceramic core element and surfaces of the opening in the base core.

A core assembly 20*b* includes a ceramic base core 10*b* (FIG. 7). A ceramic core element 14*b* is received in an opening 12*b* formed in the ceramic base core 10*b*. Filler material 16*b* fills the opening 10*b*. The base core 10*b*, filler material 16*b* and ceramic core element 14*b* form the core assembly 20*b*. The core assembly 20*b* has a configuration corresponding to a configuration of a desired space in a cast metal article. In the embodiment of FIG. 7, the filler material 16*b* is disposed at only one side of the ceramic core element 14*b*.

The core element 14*b* is formed of a ceramic material and has the configuration of a flat plate. Of course, the ceramic core element may be formed with a different configuration. The ceramic core element 14*b* may be formed with holes, projections, and/or tabs. For example, the core element 14*b* may have an arcuate configuration with radially and/or axially extending flanges. The ceramic core element 14*b* may be formed as a wire. The ceramic core element 14*b* may be formed as one piece or a plurality of pieces.

The ceramic core element 14*b* may be formed of many different ceramic materials. However, it is believed that it may be preferred to form the ceramic core element 14*b* of alumina ($Al_2O_3$). The core element 14*b* has a coefficient of thermal expansion of approximately $8.8\times10^{-6}$ inches per inch per degree centigrade. Of course, the ceramic core element 14*b* may be formed of a material other than alumina and have a different coefficient of thermal expansion. The filler material 16*b* has a coefficient of thermal expansion which is greater than the coefficient of thermal expansion of the ceramic base core 10*b* and less than the coefficient of thermal expansion of the ceramic core element 14*b*.

There are two interfaces between the ceramic filler material 16*b* and other components of the core assembly 20*b*. The first interface 44*b* (FIG. 7) is formed where the filler material 16*b* and engages the ceramic core element 14*b*. At the interface 44*b*, a surface 48*b* of the ceramic filler material 16*b* engages a surface 50*b* on the ceramic core element 14*b*. During firing of the core assembly 20*b*, force is transmitted between the ceramic core element 14*b* and the ceramic filler material 16*b* across the interface 44*b*. This force results from the different coefficients of thermal expansion of the ceramic core element 14*b* and the ceramic filler material 16*b*.

A second interface 54*b* is formed where the filler material 16*b* engages the ceramic base core 10*b*. At the second interface 54*b*, a surface 58*b* of the filler material 16*b* engages a surface 60*b* on the ceramic base core 10*b*. The surface 60*b* forms one side of the opening 12*b* and faces toward and is spaced from the surface 50*b* on the ceramic core element 14*b*.

During firing of the core assembly 20*b* force is transmitted between the ceramic filler material 16*b* and the ceramic base core 10*b* across the interface 54*b*. Force is also transmitted between the ceramic filler materials 16*b* and the ceramic core element 14*b* across the interface 44*b*. These forces result from different coefficients of thermal expansion of the ceramic core element 14*b*, the filler material 16*b*, and the base core 10*b*. By providing two interfaces, that is, the interface 44*b* and the interface 54*b*, the magnitude of the force transmitted at either one of the interfaces is reduced. This results in a reduction in stress on the material of the ceramic base core 10*b* and the ceramic filler material 16*b*.

The coefficient of thermal expansion of the base core 10 is increased so that it approaches the coefficient of thermal expansion of the ceramic core element 14*b*. The alumina of the ceramic core element 14*b* may have a coefficient of thermal expansion of approximately $8.8\times10^{-6}$ inches per inch per degree centigrade. The base core 10*b* is formed of a mixture of silica and zircon. Silica has a coefficient of thermal expansion of approximately $0.5\times10^{-6}$ inches per inch per degree centigrade. Zircon has a coefficient of thermal expansion of approximately $4.2\times10^{-6}$ inches per inch per degree centigrade.

To increase the thermal expansion of the base core 10*b*, the base core is formed of a mixture of silica and zircon. The greater the amount of zircon provided in the base core 10*b*, the greater will be the coefficient of thermal expansion of the base core 10*b*. It is contemplated that the base core 10*b* may have a silica content of 70% or less and a zircon content of 30% or more. However, the base core 10*b* may have a different composition if desired.

The silica and zircon forming the ceramic base core 10*b* may have the same particle size. By providing silica and zircon with substantially the same particle size, voids between relatively large particles of one material are not filled by relatively small particles of the other material. This enables a mixture of zircon and silica particles to have a relatively large coefficient of thermal expansion.

The filler material 16*b* may be a slurry which is a water based mixture of silica and zircon. If this is the case, the filler material 16*b* may have a greater zircon content than the base core 10*b*. The slurry of silica and zircon is used to fill the opening 12*b* after the ceramic core element has been positioned in the opening.

When the core assembly 20*b* is dried, water is removed from the silica and zircon of the ceramic filler material 16*b*. This results in shrinkage of the filler material 16*b*. When the core assembly is fired, additional water is removed from the ceramic filler material 16*b*. This results in additional shrinkage of the ceramic filler material 16*b*.

The silica and zircon in the filler material 16*b* may have the same particle size. By providing silica and zircon with substantially the same particle size, voids between particles are not filled with other particles. This enables the silica and zircon ceramic filler material 16*b* to have a relatively large coefficient of thermal expansion.

Alternatively, the ceramic filler material 16*b* may be formed of mullite ($3Al_2O_3.2SiO_2$) with a binder. Mullite has a coefficient of thermal expansion of 5.3 inches per inch per degree centigrade. In one embodiment of the invention, the ceramic filler material 16*b* was approximately 60% silica and 40% mullite. The resulting mixture had a coefficient of thermal expansion of approximately $3.0\times10^{-6}$ inches per inch per degree centigrade. Of course different percentages of silica and mullite may be used. This may result in the filler material 16*b* having a different coefficient of thermal expansion.

The silica and mullite filler material 16*b* has a coefficient of thermal expansion which is greater than the coefficient of thermal expansion of the ceramic base core 10*b* and less than the coefficient of thermal expansion of the ceramic core element 14*b*. The silica and mullite filler material 16*b* may be a slurry which is a water based mixture of silica and mullite.

The foregoing percentages of silica, zircon, and/or mullite for use in the base core 10*b* and/or filler material 16*b* have been set forth herein for purposes of clarity of description. It is not intended to limit the invention to a specific percentage of silica, zircon, and/or mullite in either the base core 10*b* or the ceramic filler material 16*b*. In addition, the foregoing specific coefficients of thermal expansion for the base core 10*b*, filler material 16*b* and ceramic core element 14*b* have been set forth herein for purposes of clarity of description. It is not intended to limit the invention to specific coefficients of thermal expansion. It should be understood that the coefficients of thermal expansion of the base core 10*b* and filler material 16*b* will vary with variations in the silica and/or mullite content of the base core and filler material.

Figure 8:
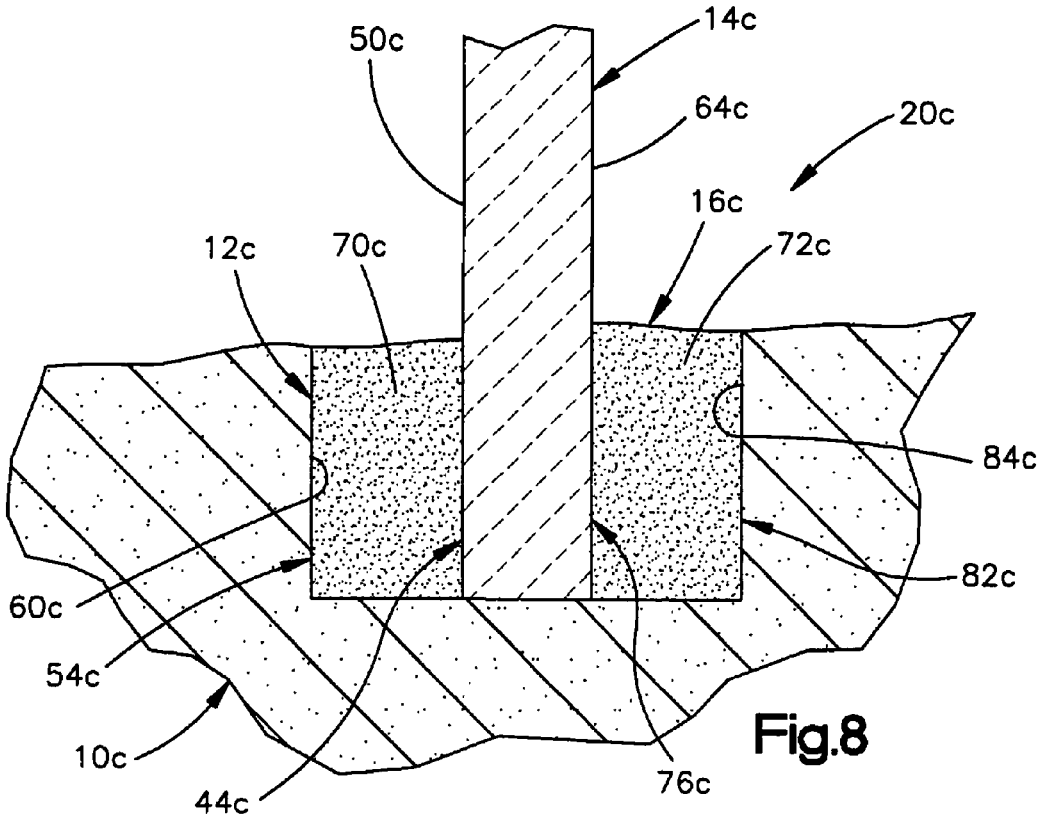
FIG. 8 is a fragmentary schematic illustration, generally similar to FIG. 6, depicting the manner in which a ceramic core element may be positioned in an opening in the base core so that the filler material is located between opposite sides of the ceramic core element and surfaces of the opening in the base core.

In the embodiment of the invention illustrated in FIG. 7, two interfaces 44*b* and 54*b* have been formed between the ceramic core element 14*b*, the filler material 16*b* and the ceramic base core 10*b*. In the embodiment of the invention illustrated in FIG. 8, four interfaces are formed between the ceramic base core, filler material and ceramic core element. Since the embodiment of the invention illustrated in FIG. 8 is generally similar to the embodiments of the invention in FIGS. 1-7, similar numerals will be utilized to identify similar components. The suffix letter "c" being associated with the numerals of FIG. 8 to avoid confusion.

A core assembly 20*c* includes a ceramic base core 10*c* (FIG. 8). A ceramic core element 14*c* is received in an opening 12*c* formed in the ceramic base core 10*c*. The ceramic filler material 16*c* is disposed on opposite sides of the ceramic core element 14*c*. Thus, a first body 70*c* of ceramic filler material is disposed on the left (as viewed in FIG. 8) side of the ceramic core element 14*c*. Similarly, a second body 72*c* of ceramic filler material is disposed on the right side of the ceramic core element 14*c*. The ceramic filler material 16*c* has a coefficient of thermal expansion which is greater than coefficient of thermal expansion of the base core 10*c* and less than the coefficient of thermal expansion of the ceramic core element 14*c*.

The two bodies 70*c* and 72*c* of ceramic filler material cooperate with the ceramic base core 10*c* and ceramic core element 14*c* to form four interfaces. Thus, a first interface 44*c* is formed where the body 70*c* of ceramic filler material 16*c* engages a side surface 50*c* of the ceramic core element 14*c*. A second interface 54*c* is formed between the first body 70*c* of ceramic filler material and a side surface 60*c* of the ceramic base core 10*c*. A third interface 76*c* is formed between the second body 72*c* of ceramic filler material and a side surface 64*c* of the ceramic core element 14*c*. A fourth interface 82*c* is formed between the second body 72*c* of ceramic filler material and a side surface 84*c* of the opening 12*c* in the base core 10*c*.

The ceramic core element 14*c* is formed of alumina. The alumina core element 14*c* has a coefficient of thermal expansion of approximately $8.8\times10^{-6}$ inches per inch per degree centigrade. The core element 14*c* may be formed of a different material and have a different coefficient of thermal expansion.

CONCLUSION

The present invention provides a new and improved method of forming a cast metal article 38. The method includes providing a ceramic base core 10 having a first coefficient of thermal expansion. A core element 14 having a second coefficient of thermal expansion is positioned in an opening 12 formed in the ceramic base core 10. The core element 14 may be formed of a refractory metal or a ceramic material. The opening 12 in the ceramic base core 10 is filled with ceramic filler material 16 having a third coefficient of thermal expansion. The third coefficient of thermal expansion may be greater than the first coefficient of thermal expansion and less than the second coefficient of thermal expansion.

Although it is contemplated that the ceramic base core 10 may have many different compositions, the ceramic base core may contain silica and zircon. The silica content may be 70% or less and the zircon content may be 30% or more. It is also contemplated that the filler material 16 may have many different compositions. However, the filler material 16 may contain silica and zircon. Alternatively, the filler material 16 may contain silica and mullite. The silica, zircon and/or mullite forming the filler material 16 may advantageously have substantially the same particle size.

The present invention includes many different features which may advantageously be utilized together as disclosed herein. Alternatively, the features may be utilized separately or in various combinations with each other and/or with features from the prior art. For example, the filler material 16 having a coefficient of thermal expansion which is greater than the coefficient of thermal expansion of the ceramic base core may not contain zircon and/or mullite and may be used with a base core 10 which does not contain zircon. As another example, a base core 10 containing zircon may be used with filler material 16 which is free of zircon and/or mullite.

Having described the invention, the following is claimed:

1. A method of forming a cast metal article, said method comprising the steps of providing a ceramic base core having a first coefficient of thermal expansion, positioning a core element having a second coefficient of thermal expansion in an opening formed in the ceramic base core, filling the opening in the ceramic base core with a filler material having a third coefficient of thermal expansion, said third coefficient of thermal expansion being greater than said first coefficient of thermal expansion and less than said second coefficient of thermal expansion, firing the ceramic base core without cracking the base core and without cracking the filler material, at least partially covering the ceramic base core and the core element with wax to form a pattern assembly having a configuration corresponding to a desired configuration of at least a portion of the cast metal article, at least partially enclosing the pattern assembly with a wet layer of ceramic mold material, firing the wet layer of ceramic mold material to form a mold, removing the wax from the mold to leave within the mold a space having a configuration corresponding to the desired configuration of the cast metal article, filling the space in the mold with molten metal, and solidifying the molten metal to form the cast metal article.

2. A method as set forth in claim 1 wherein said step of providing a ceramic base core includes providing a ceramic base core which contains silica and zircon, said step of filling the opening in the base core with a filler material includes filling the opening with a filler material containing silica and zircon.

3. A method as set forth in claim 2 wherein said step of filling the opening in the ceramic base core with a filler material containing silica and zircon includes filling the opening in the ceramic base core with a filler material containing silica and zircon having substantially the same particle size.

4. A method as set forth in claim 1 wherein said step of positioning a core element having a second coefficient of thermal expansion in an opening formed in the ceramic base core includes positioning a core element formed of a refractory metal in the opening formed in the ceramic base core.

5. A method as set forth in claim 4 wherein said step of positioning a core element formed of a refractory metal in the opening formed in the ceramic base core includes positioning a core element formed of molybdenum in the opening formed in the base core.

6. A method as set forth in claim 1 wherein said step of positioning a core element having a second coefficient of thermal expansion in an opening formed in the ceramic base core includes positioning a core element formed of a ceramic material in the opening formed in the ceramic base core, said core element being formed of a ceramic material which is different than a ceramic material forming the ceramic base core.

7. A method as set forth in claim 6 wherein said step of positioning a core element formed of a ceramic material in the opening formed in the ceramic base core includes positioning a core element formed of alumina in the opening formed in the ceramic base core.

8. A method as set forth in claim 1 wherein said step of filling the opening in the base core with a filler material having a first coefficient of thermal expansion includes forming a first interface where the filler material engages the core element and a second interface where the filler material engages the base core, said step of firing the ceramic base core includes transmitting force between the core element and the filler material at the first interface and transmitting force between the base core and the filler material at the second interface.

9. A method as set forth in claim 1 wherein said step of positioning a core element having a second coefficient of thermal expansion in an opening formed in the base core includes positioning a portion of the core element in the opening with a first side of the portion of the core element facing toward and spaced from a first surface area disposed on the base core and with a second side of the portion of the core element facing toward and spaced from a second surface area disposed on the base core, said step of filling the opening in the base core with filler material includes positioning filler material between the first side of the core element and the first surface area on the base core to form a first interface where the filler material engages the first side of the core element and a second interface where the filler material engages the first surface area on the base core, said step of filling the opening in the base core with filler material includes positioning filler material between the second side of the core element and the second surface on the base core to form a third interface where the filler material engages the second side of the core element and a fourth interface where the filler material engages the second surface area on the base core, said step of firing the ceramic base core includes transmitting force between the core element and the filler material at the first and third interfaces and transmitting force between the base core and the filler material at the second and fourth interfaces.

10. A method as set forth in claim 9 wherein said step of providing a ceramic base core includes providing an unfired ceramic base core which contains silica and zircon, said step of filling the opening in the base core with a filler material includes filling the opening with a filler material containing silica and zircon.

11. A method as set forth in claim 10 wherein said step of filling the opening in the ceramic base core with a filler material containing silica and zircon includes filling the opening in the ceramic base core with a filler material containing silica and zircon having substantially the same particle size.

12. A method as set forth in claim 10 wherein said step of positioning a core element having a second coefficient of thermal expansion in an opening formed in the ceramic base core includes positioning a core element formed of a refractory metal in the opening formed in the ceramic base core.

13. A method as set forth in claim 12 wherein said step of positioning a core element formed of a refractory metal in the opening formed in the ceramic base core includes positioning a core element formed of molybdenum in the opening formed in the base core.

14. A method as set forth in claim 10 wherein said step of positioning a core element having a second coefficient of thermal expansion in an opening formed in the ceramic base core includes positioning a core element formed of a ceramic material in the opening formed in the ceramic base core, said core element being formed of a ceramic material which is different than a ceramic material forming the ceramic base core.

15. A method as set forth in claim 14 wherein said step of positioning a core element formed of a ceramic material in the opening formed in the ceramic base core includes positioning a core element formed of alumina in the opening formed in the base core.

16. A method as set forth in claim 1 wherein said step of providing a ceramic base core having a first coefficient of thermal expansion includes providing a ceramic base core containing silica and zircon with a silica content of 70% or less and a zircon content of 30% or more.

17. A method as set forth in claim 16 wherein said step of filling the opening in the ceramic base core with a ceramic filler material includes filling the opening in the ceramic base core with filler material containing silica and zircon with a silica content of 70% or less and a zircon content of 30% or more.

18. A method as set forth in claim 1 wherein said step of filling the opening in the ceramic base core with a filler material includes filling the opening in the ceramic base core with a filler material containing mullite.

19. A method of forming a cast metal article, said method comprising the steps of providing a ceramic base core having a first coefficient of thermal expansion, said step of providing a ceramic base core having a first coefficient thermal expansion includes providing a ceramic base core containing silica and zircon of substantially the same particle size and with a silica content of 70% or less and a zircon content of 30% or more, positioning a core element having a second coefficient of thermal expansion in an opening formed in the ceramic base core, said step of positioning a core element having a second coefficient of thermal expansion in the ceramic base core includes positioning a core element formed of a refractory metal in the opening formed in the ceramic base core, filling the opening in the ceramic base core with a filler material having a third coefficient of thermal expansion, said third coefficient of thermal expansion being greater than said first coefficient of thermal expansion and less than said second coefficient of thermal expansion, said step of filling the opening in the ceramic base core with a filler material having a third coefficient of thermal expansion includes filling the opening in the ceramic base core with filler material containing silica and zircon of substantially the same particle size and with a silica content of 70% or less and a zircon content of 30% or more, firing the ceramic base core without cracking the base core and without cracking the filler material, at least partially covering the ceramic base core and the core element with wax to form a pattern assembly having a configuration corresponding to a desired configuration of at least a portion of the cast metal article, at least partially enclosing the pattern assembly with a wet layer of ceramic mold material, firing the wet layer of ceramic mold material to form a mold, removing the wax from the mold to leave within the mold a space having a configuration corresponding to the desired configuration of the cast metal article, filling the space in the mold with molten metal, and solidifying the molten metal to form the cast metal article.

* * * * *